US012203710B2

(12) United States Patent
Ingenito et al.

(10) Patent No.: US 12,203,710 B2
(45) Date of Patent: Jan. 21, 2025

(54) HEAT EXCHANGER HAVING OPTIMIZED FLUID PASSAGES

(71) Applicant: LIEBHERR-AEROSPACE TOULOUSE SAS, Toulouse (FR)

(72) Inventors: Johanna Ingenito, Toulouse (FR); Romain Angelique, Toulouse (FR); Florian Bonnivard, Toulouse (FR); Mickael Bregoli, Toulouse (FR); Grégoire Hanss, Toulouse (FR); Jérôme Rocchi, Toulouse (FR)

(73) Assignee: LIEBHERR-AEROSPACE TOULOUSE SAS, Toulouse (FR)

( * ) Notice: Subject to any disclaimer, the term of this patent is extended or adjusted under 35 U.S.C. 154(b) by 229 days.

(21) Appl. No.: 17/783,068

(22) PCT Filed: Dec. 15, 2020

(86) PCT No.: PCT/FR2020/052436
§ 371 (c)(1),
(2) Date: Jun. 7, 2022

(87) PCT Pub. No.: WO2021/123597
PCT Pub. Date: Jun. 24, 2021

(65) Prior Publication Data

US 2023/0023640 A1 Jan. 26, 2023

(30) Foreign Application Priority Data

Dec. 20, 2019 (FR) ..... 1915230

(51) Int. Cl.
*F28F 3/02* (2006.01)
*F28D 9/00* (2006.01)
*F28F 3/06* (2006.01)

(52) U.S. Cl.
CPC ..... *F28D 9/0025* (2013.01); *F28D 9/0062* (2013.01); *F28F 3/025* (2013.01); *F28F 3/06* (2013.01)

(58) Field of Classification Search
CPC ..... F28F 3/025
See application file for complete search history.

(56) References Cited

U.S. PATENT DOCUMENTS 2,567,030 A * 9/1951 Schaaf ..... B01D 46/10 55/497
2,764,257 A * 9/1956 Brixius ..... B01D 46/10 55/489

(Continued)

FOREIGN PATENT DOCUMENTS

JP 6642603 B2 * 2/2020 ..... F28D 9/0037

*Primary Examiner* — Nelson J Nieves
(74) *Attorney, Agent, or Firm* — CRGO Global; Steven M. Greenberg

(57) ABSTRACT

The invention relates to a heat exchanger that is configured to permit an exchange of heat between a first fluid and a second fluid that circulate in passage paths formed by plates (14*a*, 14*b*) and fins (16*a*, 16*b*) of the heat exchanger, the fluids flowing in a multitude of passage channels (10) each consisting of a closed space (12) delimited by two adjacent plates and two adjacent fins, characterized in that each plate extends along a non-planar surface following at least a first oscillating curve, and each fin further following at least one second oscillating curve along at least one second main direction, in such a way that each passage path allows the fluid to flow in the closed space along a fluid direction defined by a generatrix that is a combination at least of the first oscillating curve and the second oscillating curve.

11 Claims, 2 Drawing Sheets

(56) References Cited

U.S. PATENT DOCUMENTS 3,982,981 A * 9/1976 Takao ..... B32B 9/06 428/184
4,333,749 A * 6/1982 Holmberg ..... F28C 1/16 55/440
4,460,388 A 7/1984 Fukami
4,589,983 A * 5/1986 Wydevan ..... B01D 46/12 210/489
4,724,902 A * 2/1988 Gross ..... F28F 21/065 165/166
5,010,594 A * 4/1991 Suzuki ..... A61M 16/1045 2/206
6,273,938 B1 * 8/2001 Fanselow ..... B01D 46/0036 55/497
7,159,649 B2 * 1/2007 Thyrum ..... F28F 9/001 165/DIG. 399
7,168,482 B2 * 1/2007 Lee ..... F28D 21/0015 165/166
7,452,589 B2 * 11/2008 Mossbeck ..... B29C 44/5654 428/179
8,021,466 B2 * 9/2011 Mater ..... B01D 46/10 55/528
9,630,132 B2 * 4/2017 Spengler ..... B01D 25/26
2008/0283476 A1 * 11/2008 Dralle ..... B01D 35/147 210/417
2012/0043064 A1 * 2/2012 Takada ..... F28F 3/025 165/166
2018/0003447 A1 4/2018 Mougnier
2018/0195424 A1 12/2018 Semura
2020/0166293 A1 * 5/2020 Turney ..... F28F 7/02
2020/0217596 A1 * 7/2020 Civeira Domínguez . F28F 1/40
2022/0316807 A1 * 10/2022 Bush ..... F24F 12/001
2023/0221076 A1 * 7/2023 Song ..... F28D 9/0037 165/166
2023/0235916 A1 * 7/2023 Wang ..... F28D 21/0015 454/252

* cited by examiner

[Fig. 1]
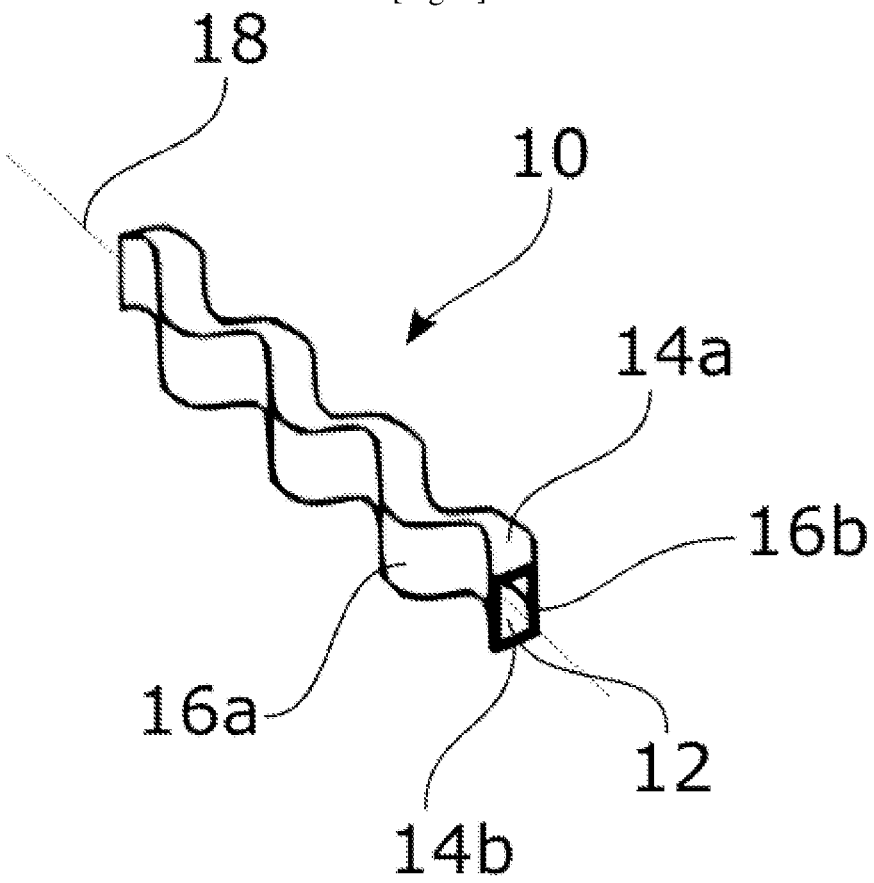
[Fig. 2]
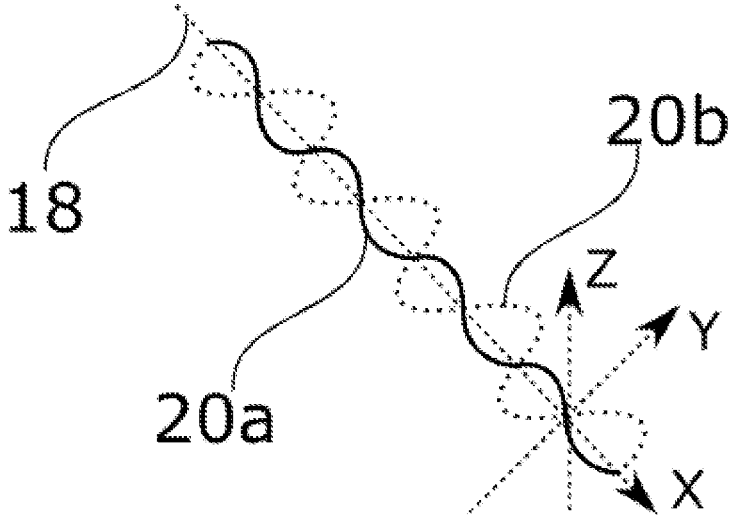

[Fig. 3]
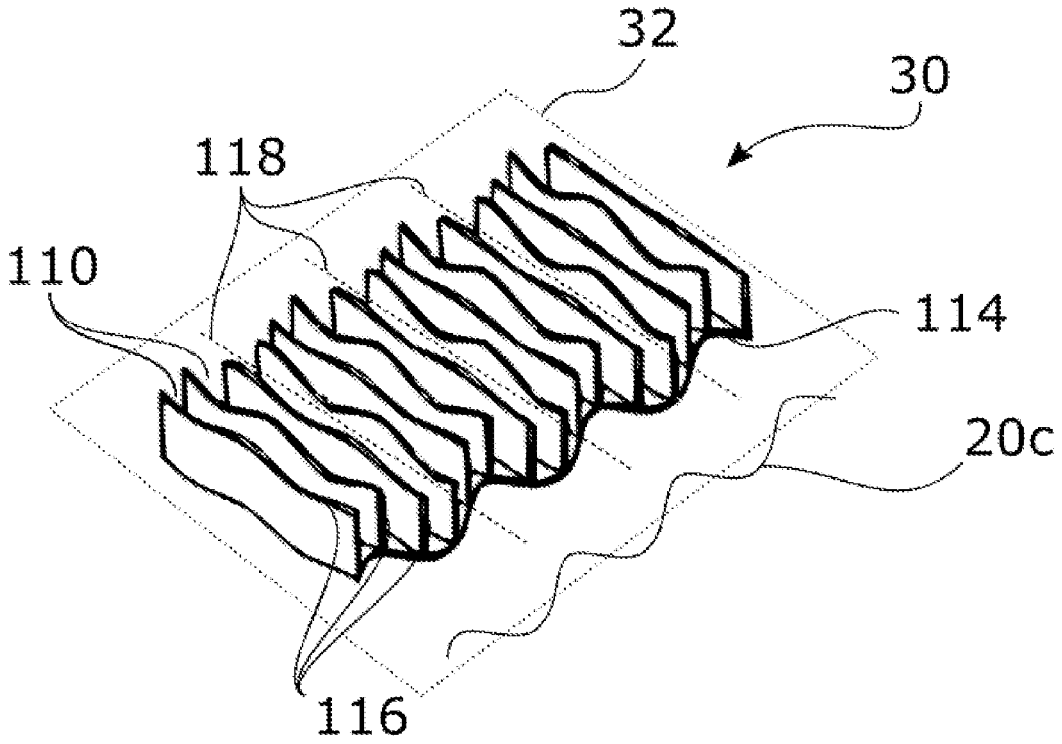
[Fig. 4]
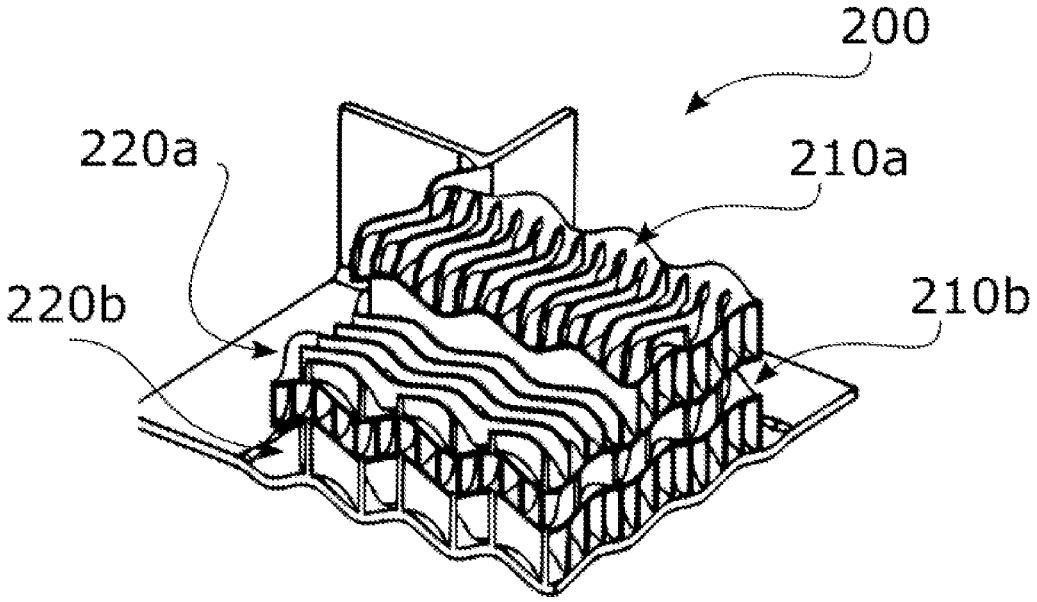

HEAT EXCHANGER HAVING OPTIMIZED FLUID PASSAGES

CROSS-REFERENCE TO RELATED APPLICATIONS

This application is a § 371 national phase entry of International Application No. PCT/FR2020/052436, filed Dec. 15, 2020, which claims priority to French Patent Application No. 1915230 filed on Dec. 20, 2019.

TECHNICAL FIELD OF THE INVENTION

The invention relates to a heat exchanger. In particular, the invention relates to a plate and fin heat exchanger that can be used in an air conditioning system, for example in an air, rail or land vehicle.

TECHNOLOGICAL BACKGROUND

Heat exchangers are used to allow an exchange of heat between at least two fluids, in particular to cool or heat one of the fluids using another fluid. Heat exchangers are used in many contexts, and in particular in air conditioning systems for air, rail or land vehicles, in which they in particular allow regulation of the temperature of the air conditioned by the air conditioning system at different stages of conditioning.

Among the different types of heat exchangers, plate and fin heat exchangers form one type of design that use plates and finned chambers to transfer heat between fluids. The flow channels formed by the plates and the fins allow the flow of each fluid without mixing with the other fluids, while maximizing the surface area/volume ratio of heat transfer. These types of exchangers are in particular praised in the transport industries, in particular air, for their compact size and their lightness, while also performing well.

For several decades, plate heat exchangers have been manufactured from a succession of flat plates, between which fins are arranged that are formed by a corrugated plate forming flow channels for each fluid. The plates and fins are fabricated independently and then brazed together to form the heat exchangers. The flat plates and corrugated plates are metallic, for example aluminum or aluminum alloy, or stainless steel.

The geometries of the fins formed by the corrugated plate can be of various shapes, for example rectangular, triangular, in waves, etc. Different configurations are used depending on the needs in terms of exchange surface, pressure drop, etc.

The inventors have sought to maximize the exchange of heat between the fluids by minimizing the pressure drop due to the passage of each fluid through the exchanger, in particular for the fluid that heats up when passing through the exchanger.

AIMS OF THE INVENTION

The invention aims to provide an optimized heat exchanger.

The invention aims in particular to provide, in at least one embodiment, a heat exchanger that maximizes the heat exchange.

The invention also aims to provide, in at least one embodiment of the invention, a heat exchanger that minimizes pressure drops.

The invention also aims to provide, in at least one embodiment of the invention, a less bulky and lighter heat exchanger.

The invention also aims to provide, in at least one embodiment of the invention, a compact heat exchanger that can be used in an air, rail or land vehicle, in particular in an air conditioning system.

DISCLOSURE OF THE INVENTION

To do this, the invention relates to a heat exchanger that is configured to permit an exchange of heat between a first fluid and a second fluid that circulate in at least a first passage path and a second passage path, respectively, said passage paths being formed by plates and fins of the heat exchanger and being configured to conduct each fluid from a fluid inlet to a fluid outlet, the fluids flowing in a multitude of passage channels each consisting of a closed space delimited by two adjacent plates and two adjacent fins, characterized in that each plate extends along a non-planar surface defined between the fluid inlet and the fluid outlet of the associated passage path, said non-planar surface following at least one first oscillating curve along at least one first main direction around an average surface of the plate, and in that each fin comprises an upper edge configured to be in contact with one of the adjacent plates, called upper plate, and a lower edge configured to be in contact with the other adjacent plate, called lower plate, each fin further following at least one second oscillating curve in at least one second main direction around an average surface of the fin, so that each passage path allows the fluid to flow in the closed space along a fluid direction between the fluid inlet and the fluid outlet, called the flow axis, defined at any point of the curve by a generatrix that is a combination at each point at least of the first oscillating curve and of the second oscillating curve.

A heat exchanger according to the invention therefore makes it possible, owing to the particular geometry of the passage channels borne by a generatrix that is a combination of at least two oscillating curves, to maximize the exchange surface between the fluids while preserving good performance in terms of pressure drops, compared to a conventional plate-fin heat exchanger. The combination of the oscillating curves allows generatrixes of different shapes to be obtained, making it possible to form any type of geometry.

The plates and the fins each follow an oscillating curve allowing the increase of the exchange surfaces without notable impact on the pressure losses.

In particular, the heat exchange efficiency is improved by around 35% for a reduction of at least 40% in mass and 20% in effective volume.

Forming channels in the heat exchanger in particular allows a much lower pressure drop than heat exchangers with multiple paths, where the fluid can follow several paths via bifurcations, said bifurcations being formed by a channel comprising the other fluid of the exchanger.

An oscillating curve is a curve lying alternately on one side and on the other of an average curve relative to this oscillating curve. According to certain variants of the invention, the oscillating curves can be periodic: the curves can for example be sinusoidal, triangular, etc.

Advantageously and according to the invention, the first curve and the second curve have the following characteristics:

$0.1<\gamma<1$ $0.2<\varepsilon<5$ with $\gamma$ being equal to the mean amplitude of the curve divided by the mean period of the curve, and $\varepsilon$ being equal to the mean pitch of the curve divided by the amplitude of the curve.

In the example of FIG. 2 showing two sinusoidal curves forming the generatrix of a passage channel as shown with reference to FIG. 1, curve 20*b* extends in the direction X, comprises crests or vertices, each forming a crest line, and comprises troughs, each forming a trough line. The crest portions and the trough portions are arranged alternately in the direction Y, which is characteristic of an oscillating curve around the x-axis. Each point on the curve can be expressed in terms of a coordinate, which can be expressed in terms of the x- and y-axes. A single x-axis coordinate value is associated with each unique point on the curve, but multiple points on the curve have the same y-axis coordinate value due to the curve's oscillation.

Similarly, curve 20*a* oscillates around the x-axis with oscillations along the z-axis.

When the average curve around which the curves 20*a* or 20*b* oscillate are not straight, the mark is expressed at each point of the curve by a main direction X that corresponds to the tangent to the average curve at this point of the curve.

The difference in height between a vertex and a trough represents the amplitude. Mean amplitude also means the mean difference in height between a vertex and a trough.

The distance between two adjacent vertices with respect to the y-axis represents the period; mean period means the mean distance between two successive vertices.

The distance between two adjacent passage channels is defined by the pitch. Mean pitch also means the mean distance between two channels.

According to this aspect of the invention, these characteristics make it possible to ensure a low pressure drop while allowing an increase in the heat exchange surface. Too large a mean amplitude with respect to the period or the pitch would cause significant pressure drops, despite the significant increase in the heat exchange surface. These characteristics allow a good compromise between the increase in the exchange surface and the pressure drops.

Advantageously and according to the invention, the first curve and/or the second curve is continuous.

Advantageously and according to the invention, the first curve and/or the second curve is discontinuous.

According to these aspects of the invention, each curve can be either discontinuous or continuous. Discontinuous curves make it possible to further increase the heat exchange surface, while continuous curves have less impact on pressure drops.

Advantageously and according to the invention, the first curve and/or the second curve are oscillating with variable amplitude and/or frequency.

According to this aspect of the invention, the amplitude or the frequency of oscillation of the curves are variable, which allows adjustment of the pressure drop or the heat exchange of the fluid, for example upstream or downstream of the channels.

Advantageously and according to the invention, the fluids are gaseous or liquid.

According to this aspect of the invention, the heat exchanger can be used in different contexts. In particular, the heat exchanger can be used in the field of transport (aeronautics, rail, land, etc.) where heat exchanges take place between gas and gas, between gas and liquid or between liquid and liquid. Each of these different types of fluids can be a hot source or a cold source.

Advantageously and according to the invention, the flow axes of the channels of the first passage are substantially parallel to the flow axes of the channels of the second passage.

According to this aspect of the invention, the exchangers thus formed are co-current or counter-current.

Advantageously and according to the invention, the flow axes of the channels of the first passage are substantially orthonormal to the flow axes of the channels of the second passage.

According to this aspect of the invention, the exchangers thus formed are cross-pass.

Advantageously and according to the invention, the exchanger is produced by additive manufacturing.

According to this aspect of the invention, additive manufacturing makes it possible to easily obtain the complex geometries formed by the channels. Advantageously, the material used can be metal, in particular a nickel alloy (Ni625, Ni718), an aluminum (AS7G06, AS10), titanium (TA6V) or stainless steel (15-5Ph, 316L, 17-4Ph) alloy or plastic materials such as polymers of the PAEK type (PEEK, PEKK, etc.) or the family of silicon carbides.

The plates and fins can be made together by additive manufacturing and form a whole. Thus, the distinction between the plates and the fins set out above and below describes a differentiation of functions, in particular in the definition of the paths and passage channels, but the entire exchanger can be manufactured in one go by additive manufacturing without having to manufacture the plates and the fins separately.

The invention also relates to a system comprising a heat exchanger according to the invention, and an aircraft comprising a heat exchanger according to the invention.

The invention also relates to a heat exchanger, an air conditioning system, and an aircraft, that are characterized in combination by all or some of the features mentioned above or below.

LIST OF FIGURES

Further aims, features and advantages of the invention will become apparent upon reading the following description, which is provided solely by way of non-limiting example, and which refers to the accompanying drawings, in which:

FIG. 1 is a schematic perspective view showing a single passage channel of a passage path of a heat exchanger according to a first embodiment of the invention.

FIG. 2 is a schematic view of the curves bearing the passage channel of the passage path of a heat exchanger according to the first embodiment of the invention.

FIG. 3 is a schematic perspective view showing a passage path of a heat exchanger according to an embodiment of the invention.

FIG. 4 is a schematic perspective view of a heat exchanger according to an embodiment of the invention.

DETAILED DESCRIPTION OF ONE EMBODIMENT OF THE INVENTION

For the sake of illustration and clarity, scales and proportions are not strictly adhered to in the drawings.

Moreover, identical, similar, or analogous elements are denoted using the same reference signs throughout the drawings.

FIG. 1 is a schematic perspective illustration of a single passage channel 10 of a passage path of a heat exchanger according to one embodiment of the invention.

The channel 10 is formed by an empty space 12 delimited by two plates 14*a* and 14*b* and two adjacent fins 16*a* and 16*b* of the heat exchanger. The channel extends in a main direction called flow axis 18, representing the direction in which a fluid passing through the exchanger moves in the channel. A section perpendicular to the directional axis forms a planar passage section closed by the walls formed by the two plates 14*a* and 14*b* and the two adjacent fins 16*a* and 16*b*. The plate 14*a* forms a plate called the upper plate and the plate 14*b* forms a plate called the lower plate. The fins are in contact with these two plates.

FIG. 2 schematically illustrates two oscillating curves 20*a* and 20*b* followed respectively by the plates 14*a* and 14*b* and by the fins 16*a* and 16*b*, allowing the undulating shape of the passage channel to be obtained.

The curves here are continuous and sinusoidal, but the curves can take different shapes, for example triangular, etc. The curves are oscillating. In this embodiment, the two curves oscillate and are periodic (that is to say, of constant frequency and of constant maximum and minimum amplitude between each period). The first oscillating curve 20*a* represents the oscillation applied to the plates 14*a* and 14*b* and the second curve 20*b* represents the oscillation applied to the fins 16*a* and 16*b*. The combination of the two curves 20*a* and 20*b* at any point corresponds to a generatrix representing the circulation of the fluid in the passage channel 10.

The curves here oscillate about the flow axis, but can oscillate in different directions, as shown in FIG. 3.

FIG. 3 shows a path 30 for the passage of a heat exchanger according to one embodiment of the invention.

A passage path 30 comprises several passage channels 110 and allows a fluid to flow, the fluid passing through the various passage channels 110 of the passage path 30. The passage path is formed by two plates (only one plate 114 being visible in the figure) and a plurality of fins 116, so as to compose the various channels 110 all oriented along axes 118 of parallel directions.

In this embodiment, one of the curves 20*c* followed by the plates forming the passage channels 110 is comprised in a plane orthogonal to the mean plane 32 of the plate 114 and thus forms the oscillating curve followed by the plate. The curve 20*c* oscillates around the mean plane 32 and therefore influences all the channels.

The other curve followed by each fin of the passage channels 110 is comprised in a plane comprising the directional axis of each passage channel 110.

FIG. 4 shows a heat exchanger 200 according to one embodiment of the invention. The heat exchanger comprises four passage paths, two passage paths 210*a* and 210*b* being intended for a first fluid and two passage paths 220*a* and 220*b* intended for a second fluid.

The passage paths are arranged alternately so as to allow heat exchange between the first and the second fluid. In this embodiment, the passage paths are arranged so that the flow axes are substantially perpendicular, so as to form a cross-pass interchange.

The invention claimed is:

1. A heat exchanger that is configured to permit an exchange of heat between a first fluid and a second fluid that circulate in at least a first passage path and a second passage path, respectively, said passage paths being formed by plates and fins of the heat exchanger and being configured to conduct each fluid from a fluid inlet to a fluid outlet, the fluids flowing in a multitude of passage channels each consisting of a closed space delimited by two adjacent plates and two adjacent fins, wherein each plate extends along a non-planar surface defined between the fluid inlet and the fluid outlet of an associated passage path, said non-planar surface following at least one first oscillating curve along at least one first main direction around an average surface of the plate, and in that each fin comprises an upper edge configured to be in contact with one of the adjacent plates, called upper plate, and a lower edge configured to be in contact with the other adjacent plate, called lower plate, each fin further following at least one second oscillating curve, different from the first oscillating curve, in at least one second main direction around an average surface of the fin, so that each passage path allows the fluid to flow in the closed space along a fluid direction between the fluid inlet and the fluid outlet, called the flow axis, defined at any point of the curve by a generatrix that is a combination at each point at least of the first oscillating curve and of the second oscillating curve.

2. The heat exchanger according to claim 1, wherein the first curve and the second curve have the following characteristics:

$$-0.1<\gamma<1$$

$$-0.2<\varepsilon<5$$

with $\gamma$ being equal to a mean amplitude of each of the curves divided by a mean period of the curves, and $\varepsilon$ being equal to a mean pitch of the curves divided by an amplitude of the curves.

3. The heat exchanger according to claim 1, wherein the first curve and/or the second curve is continuous.

4. The heat exchanger according to claim 1, wherein the first curve and/or the second curve is discontinuous.

5. The heat exchanger according to claim 1, wherein the first curve and/or the second curve are oscillating with variable amplitude and/or frequency.

6. The heat exchanger according to claim 1, wherein the fluids are gaseous or liquid.

7. The heat exchanger according to claim 1, wherein the flow axes of the channels of the first passage are substantially parallel to the flow axes of the channels of the second passage.

8. The heat exchanger according to claim 1, wherein the flow axes of the channels of the first passage are substantially orthogonal to the flow axes of the channels of the second passage.

9. The heat exchanger according to claim 1, wherein the heat exchanger is produced by additive manufacturing.

10. An air conditioning system comprising:

a heat exchanger that is configured to permit an exchange of heat between a first fluid and a second fluid that circulate in at least a first passage path and a second passage path, respectively, said passage paths being formed by plates and fins of the heat exchanger and being configured to conduct each fluid from a fluid inlet to a fluid outlet, the fluids flowing in a multitude of passage channels each consisting of a closed space delimited by two adjacent plates and two adjacent fins, each plate extending along a non-planar surface defined between the fluid inlet and the fluid outlet of the associated passage path, said non-planar surface following at least one first oscillating curve along at least one first main direction around an average surface of the plate, and in that each fin comprises an upper edge configured to be in contact with one of the adjacent plates, called upper plate, and a lower edge configured to be in contact with the other adjacent plate, called lower plate, each fin further following at least one second oscillating curve, different from the first oscillating curve, in at least one second main direction around an average surface of the fin, so that each passage path allows the fluid to flow in the closed space along a fluid direction between the fluid inlet and the fluid outlet, called the flow axis, defined at any point of the curve by a generatrix that is a combination at each point at least of the first oscillating curve and of the second oscillating curve.

11. An aircraft comprising:

a heat exchanger that is configured to permit an exchange of heat between a first fluid and a second fluid that circulate in at least a first passage path and a second passage path, respectively, said passage paths being formed by plates and fins of the heat exchanger and being configured to conduct each fluid from a fluid inlet to a fluid outlet, the fluids flowing in a multitude of passage channels each consisting of a closed space delimited by two adjacent plates and two adjacent fins, each plate extending along a non-planar surface defined between the fluid inlet and the fluid outlet of the associated passage path, said non-planar surface following at least one first oscillating curve along at least one first main direction around an average surface of the plate, and in that each fin comprises an upper edge configured to be in contact with one of the adjacent plates, called upper plate, and a lower edge configured to be in contact with the other adjacent plate, called lower plate, each fin further following at least one second oscillating curve, different from the first oscillating curve, in at least one second main direction around an average surface of the fin, so that each passage path allows the fluid to flow in the closed space along a fluid direction between the fluid inlet and the fluid outlet, called the flow axis, defined at any point of the curve by a generatrix that is a combination at each point at least of the first oscillating curve and of the second oscillating curve.

* * * * *